US006569287B2

(12) United States Patent
Hoffman

(10) Patent No.: US 6,569,287 B2
(45) Date of Patent: May 27, 2003

(54) SYSTEM AND METHOD OF PRODUCING CORRUGATED PRODUCTS WITH ON-LINE CORRUGATION

(75) Inventor: Roger P. Hoffman, Green Bay, WI (US)

(73) Assignee: The Hoffman Group, Ltd., Green Bay, WI (US)

( * ) Notice: Subject to any disclaimer, the term of this patent is extended or adjusted under 35 U.S.C. 154(b) by 18 days.

(21) Appl. No.: 09/734,153

(22) Filed: Dec. 11, 2000

(65) Prior Publication Data

US 2003/0041986 A1 Mar. 6, 2003

Related U.S. Application Data

(60) Provisional application No. 60/170,331, filed on Dec. 13, 1999.

(51) Int. Cl.[7] ..... D21F 11/12

(52) U.S. Cl. ..... 162/132; 162/133; 162/201; 162/289; 162/300; 162/304; 162/305; 162/381

(58) Field of Search ..... 162/117, 201, 162/289, 381, 132, 133, 300, 304, 305; 156/210, 470

(56) References Cited

U.S. PATENT DOCUMENTS

| | | | | |
|---|---|---|---|---|
| RE24,361 E | * | 9/1957 | Brown | 162/117 |
| 4,046,622 A | * | 9/1977 | Attwood et al. | 162/201 |
| 4,285,764 A | * | 8/1981 | Salvai | 162/132 |

* cited by examiner

*Primary Examiner*—Peter Chin
(74) *Attorney, Agent, or Firm*—Philip M. Weiss; Weiss & Weiss

(57) ABSTRACT

The present invention relates to a system and method of making paperboard and paperboard corrugation that negates the steps of winding rolls of containerboard on machine reels of separate paper machines, subsequent rewinding and slitting of paperboard and unwinding rolls of containerboard on separate corrugators.

11 Claims, 4 Drawing Sheets

SYSTEM AND METHOD OF PRODUCING CORRUGATED PRODUCTS WITH ON-LINE CORRUGATION

This application claims benefit of Prov. patent application Ser. No. 60/170,331 filed Dec. 13, 1999.

FIELD OF THE INVENTION

The present invention relates to a system and method of making paperboard and paperboard corrugation that negates the steps of winding rolls of containerboard on machine reels of separate paper machines, subsequent rewinding and slitting of paperboard and unwinding rolls of containerboard on separate corrugators.

BACKGROUND OF THE INVENTION

In the prior art, linerboard is made on a single machine where the product is wound into a roll. Corrugating medium is also made on a separate machine and then wound on a roll. Normally corrugating medium and linerboard are made on different machines because of different characteristics of the two boards. The rolls of containerboard are then, subsequently slit and rewound to fit the corrugator's width, which is typically narrower than the board machine. The rolls are subsequently brought to a separate facility where the corrugator is located where the rolls are placed on unwind stands and unwound to be made into corrugated sheet. With all of the costs involved in transportation, and winding and unwinding of rolls, and keeping inventory of the rolls (at both the corrugator and paperboard manufacturing facilities) this becomes a very inefficient process.

SUMMARY OF THE INVENTION

The present invention involves a method of paperboard corrugation that produces at least one continuous web of containerboard at a papermaking segment of the process that continuously feeds the containerboard web or webs from the dry-end of the papermaking segments into another segment of the process that converts the webs into corrugation board (the corrugation segment). Containerboard is defined as paperboard used to make corrugated containers, corrugating medium plus linerboard. This process negates the steps of winding rolls of paper on paper machine reels, rewinding and slitting paper on rewinders, and unwinding of rolls of paperboard on conventional corrugators. While only a single or two webs of containerboard can be produced at the papermaking segments (thereby requiring the remaining web or webs needed for producing the corrugated board to be fed into the corrugation segment by unwinding rolls of containerboard with traditional roll unwinders), it is considered more advantageous to feed all three webs from papermaking segments into the corrugation segment.

When all three webs are continuously fed from papermaking segments, all the necessary containerboard webs are be produced in a single process for combining the webs into single wall corrugated board, which represents approximately 90% of the corrugated board market. Additional webs could be unwound for making double or triple wall products (the remaining 10% of the market).

An object of the invention is to eliminate winding and unwinding of webs. This eliminates a great deal of capital, manning requirements, transportation costs, energy and plant floor space requirements.

A further object of the invention is to eliminate or reduce web pre-heating equipment found on prior art corrugators.

This equipment may be unnecessary as the webs are of sufficient temperature from the paper forming segments to effectively perform the corrugation process without preheating.

The present invention relates to a system for producing corrugated board comprising; an inside linerboard segment, an outside liner board segment, and a corrugating medium segment all being formed continuously or in one process. The three segments can be in many different configurations. The system can comprise all three segments in one line. It is a further object of the present invention for the corrugating medium segment and inside linerboard segment to be placed back to back. It is an object of the present invention to place two of the segments back to back and the third segment placed above or below one of the two back to back segments. It is a further object of the invention for the segments to be oriented in a stacked fashion. It is a further object of the invention to have any one of the segments being formed from pulp and the other two segments unwound from a roll during the same process to manufacture the corrugated paperboard. It is an object of the present invention for the corrugating medium to be produced from pulp and the inside liner board segment and the outside linerboard segment to be delivered via rolls.

It is an object of the present invention to have each of the segments comprise; a headbox, paper forming section, press section and a dryer section. It is an object of the present invention for each of the segments to have an air laid fourdrinier. It is a further object of the invention for the system to comprise a print side linerboard forming segment having a calendar section to add smoothness.

It is an object of the present invention to provide a method of paperboard corrugation comprising; delivering pulp to an inside linerboard segment, corrugating medium segment and an outside linerboard segment. The pulp is then converted into three separate containerboard webs. The corrugating medium web is then fluted. The inside linerboard web is bonded to the corrugating medium web forming a single face corrugated web. The single corrugated web is joined to the outside linerboard web forming a single wall corrugated board. It is an object of the present invention to add smoothness to the outside linerboard web prior to joining with the single face web. It is a further object of the present invention to slit and cut the single wall corrugated board into corrugated sheets. It is an object of the present invention to move broke from the paperboard corrugation system to a pulper for repulping to create fibers to re-enter the system of the present invention.

The present invention can be accomplished using conventional equipment, i.e. fourdrinier or cylinder forming equipment or using non-conventional equipment.

DETAILED DESCRIPTION OF THE INVENTION

Figure 1:
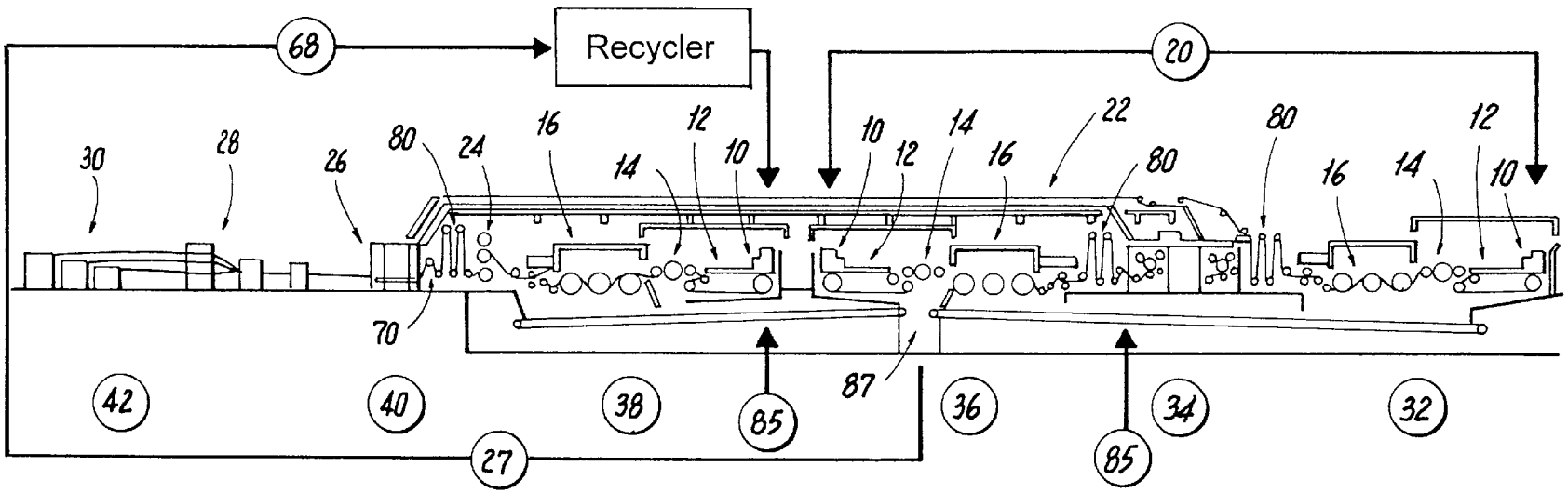
FIG. 1 shows a facility for producing corrugated products.

In one embodiment, the present invention comprises three board forming machine segments that can be oriented in many fashions. One example is to have all three forming segments in line. In this embodiment the webs all travel in the same direction and the board forming segments are placed one after the other in line. Since the speed of the three forming segments could be relatively slow compared to high speed containerboard machines, the length of the combined three forming segments of the machine can have the approximate length of a typical containerboard paper machine.

In an embodiment of a single line configuration, the first board forming section has a headbox and paper forming section followed by a single or double press to further remove water and consolidate the fibers followed by a dryer section. These sections can be conventional sections found on current containerboard machines. In a further embodiment, an air laid former can be used with any of the segments. The web leaving the dryer section travels over the remaining two board forming sections that are lined up behind it. In a preferred embodiment, the web passing over the remaining forming sections has an adequate guidance system and sufficient protection from any undesirable elements of the subsequent board forming sections of the forming segment. Each subsequent board forming segment has similar process and layout. In a preferred embodiment, the print side linerboard forming segment may also include a conventional calendar section at the end of the dryer section to provide enhanced smoothness.

In another embodiment, the corrugating medium board forming segment and the inside linerboard board forming segment are placed back-to-back (i.e., the webs are traveling in opposite directions on each of the board forming sections so that the webs leaving the two forming sections in relative proximity of each other) with their respective webs being joined together at the single facer subsegment of the corrugator segment which is located between the two board forming segments supplying the webs. From the single facer subsegment, the single face corrugated web proceeds over the final board forming segment (producing the print side liner). The corrugated single face web then joins the print side liner formed on the final board forming segment at the double backer corrugator subsegment.

In a slight variation of the above embodiment, the first two board forming segments are not placed back to back, but rather are placed one after the other in line with the two webs traveling in the same direction. In this embodiment the inside liner board web travels over the corrugating medium board forming segment and is joined with the corrugation medium web at the single facer subsegment (located behind the corrugating medium board forming segment). Similar to the back to back embodiment, the single faced corrugated web proceeds over the final board forming segment (the print side linerboard forming segment) and is joined with the print side linerboard web on the double backer corrugator subsegment.

Additional layouts include two paperboard forming segments placed back to back with the third board forming segment located above or below one of the two back to back board forming segments. In this embodiment, the corrugator subsegments (the single facer and double backer) could also be located above or below the other back to back forming segments.

A further embodiment can have at least two of the board forming segments located side by side, with the paper webs being directed to line up on top of each other for delivery into the corrugator segment. Yet another embodiment has at least two of the board webs being produced on a single board forming segment that produces a single web that is slit in half (because the web at this point is twice as wide as the corrugator) and the two webs are then oriented to enter the corrugator segment on top of each other. The third web (which would be the corrugating medium, since it must travel faster than the linerboard facings due to the additional length required for fluting) could either be formed on another forming segment or be in roll form (from another paper machine) that is unwound at the corrugator segment.

In a further embodiment, the invention comprises any one of the segments (inside linerboard, corrugating medium or outside linerboard) being formed from pulp and the other two segments unwound from a roll during the same process to manufacture the corrugated paperboard. In a further embodiment, the invention comprises the corrugating medium being produced from pulp and the inside liner board segment and the outside linerboard segment being delivered via rolls.

There are several other potential configurations or layouts that may be employed.

The corrugation segments can take the form of any current methodologies for corrugator. For example, one web could be fluted on a corrugator roll then laminated to another board web section referred to as the single facer. This combined web could be laminated to the third web in a section referred to as a double backer.

For clarification purposes, the multi-board forming machine segments should be contrasted to a multi-ply paperboard machine. Such multi-ply machines form multiple plys on the forming section of the wet end of a paper machine. Such machines have separate headboxes that form separate plys. The plys are, however, formed on top of each other on the forming fabric, with the multiple plys leaving the wire section already partially bonded to each other. From the wire, the partially bonded plys are pressed and dried together further bonding them into a single multi-ply web. This web is virtually always wound into a reel of paperboard. This is in contrast to the present invention, which forms, presses and dries separate webs of paperboard to create multiple webs of paperboard. Each of these webs can be single-ply or multi-ply formed in traditional manner or may have forming devices unique to the relatively slow speed of paper formation that likely take place in such process.

FIG. 1 illustrates an embodiment wherein pulp 20 is delivered from storage tanks or chests 58 to headboxes 10 located in the inside linerboard, corrugating medium and outside linerboard making segments (32, 36, 38 respectively). Pulp 20 is converted into three separate containerboard webs in board making segments 32, 36 and 38 by being distributed from headboxes 10 onto forming sections 12, subsequently traveling through press sections 14 and dryer sections 16. To add smoothness to the outside linerboard web (the print side linerboard web that forms the outside layer of a corrugated container), the linerboard web first travels through the calendar section 24 which imparts a smoothness characteristic to the web. Forming segments 36 and 32 are orientated so as to form their respective webs in a manner in which the webs travel in a direction towards single facer segment 34. The webs produced in board making segments 32 and 36 leave the dry ends of segments 32 and 36 and enter the single facer segment 34 where the corrugating medium web from the corrugating medium segment 36 is fluted and bonded with adhesive to the inside linerboard web that was produced on board making segment 32. The combined webs, which are referred to as single face corrugated web, exits the single facer segment 34 and travels on bridge 22 which is located over board making segment 38. The single face corrugated web exits the bridge 22 and enters the double backer corrugating segment 40 along with the outside linerbaord web produced on board making segment 38. The outside linerboard web and the single face web are joined with adhesive in the double backer corrugating segment 40 by double backer 26. The combined webs are now referred to as a single wall corrugated board. The board exits the double backer segment 40 where it is typically slit and cut into corrugated sheets at a slittter/cutter 28. Sheets are then typically stacked and delivered on down stacker 30 located in the dry end segment 42.

Traditional festooning sections 80 can be used to provide operators with the flexibility to allow for short stoppages of the corrugation segments 34 and 40. Additional web take up is also provided conventionally on bridge 22.

For producing the less common double wall and triple wall corrugated products, unwind stands 70 can be located near single facer segment 34 and the doublebacker segment 40. These unwind stands 70 would unwind webs of board that can be joined with adhesive to each other and to the webs formed on board forming segments 30, 34 and 38 in the single facer segment 34 and double backer segment 40.

Broke (wet pulp fibers and dry paper breaks) 27 that falls beneath the board making segments can travel on wet conveyors 85 to a common pulper 87 for repulping the fibers to re-enter the system. Similarly, waste at the corrugator segments can be gathered to be placed in a pulper to recover fibers for re-manufacture into board.

The stacked sheets from the embodiment can then travel to an on-site corrugated container converting equipment that converts the sheets to corrugated containers or can be bound for shipment to sheet plants for conversion into corrugated containers.

Figure 2:
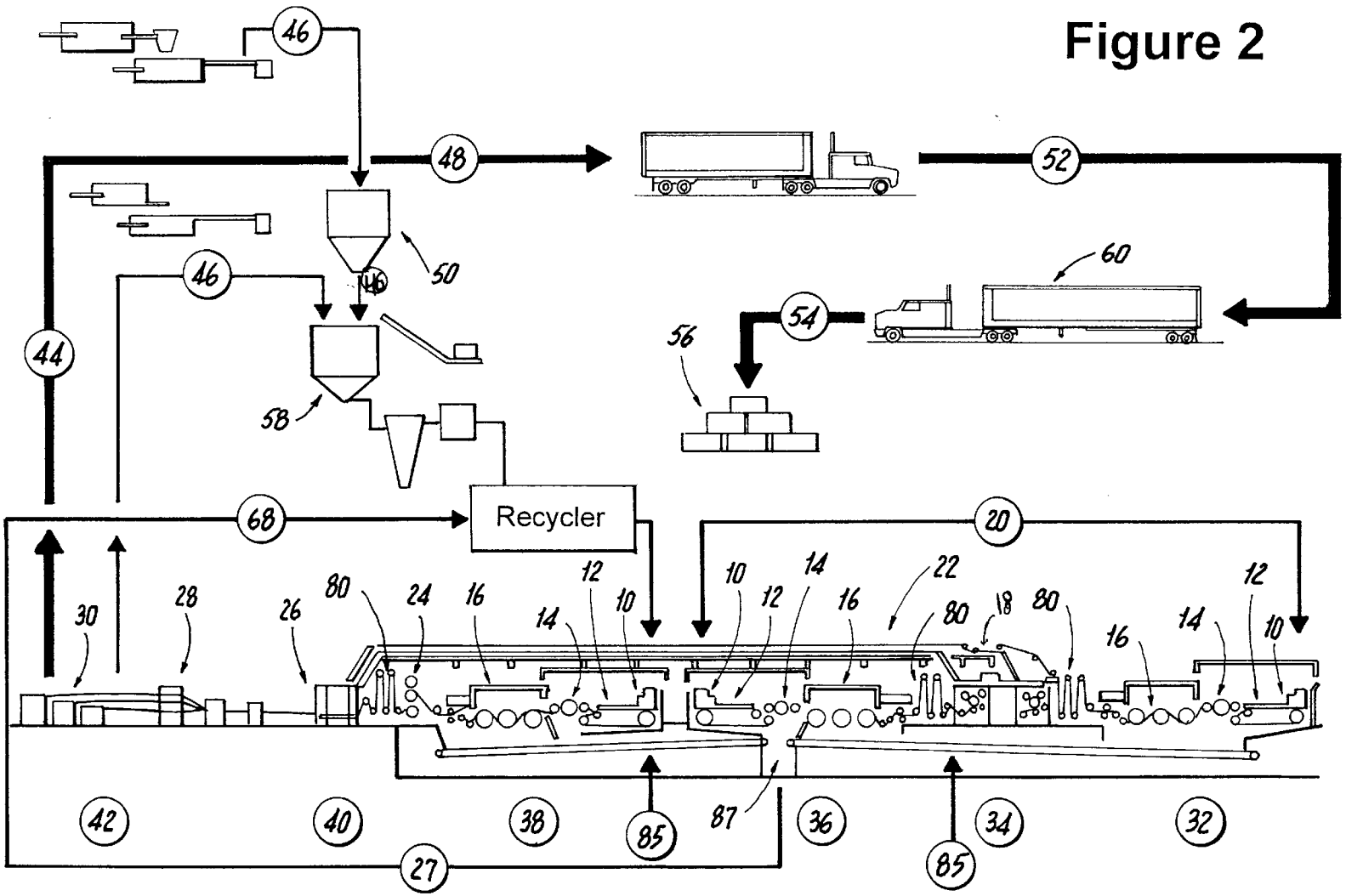
FIG. 2 shows a facility for producing corrugated products.

FIG. 2 illustrates the logistic benefit of the invention within the entire process in a recycled corrugated container facility. Vehicles 60 deliver typical furnish of old corrugated containers (OCC) and Mixed Office Waste (MOW) 54 to the facility. The furnish is placed in a pulper 58 where it is repulped into pulp. The pulp is processed through screening, cleaning and refining systems. The processed pulp is delivered to storage tanks or chests 68. Pulp is then delivered to machine 22, which was described above (FIG. 1). Broke 27 from the machine segments and trimmings 46 from the corrugation process (at the single facer and the double facer sections) as well as trim 46 from on-site corrugated converting 48 can be re-entered into the pulping process either ahead or behind the screening, cleaning and refining sections.

Figure 3:
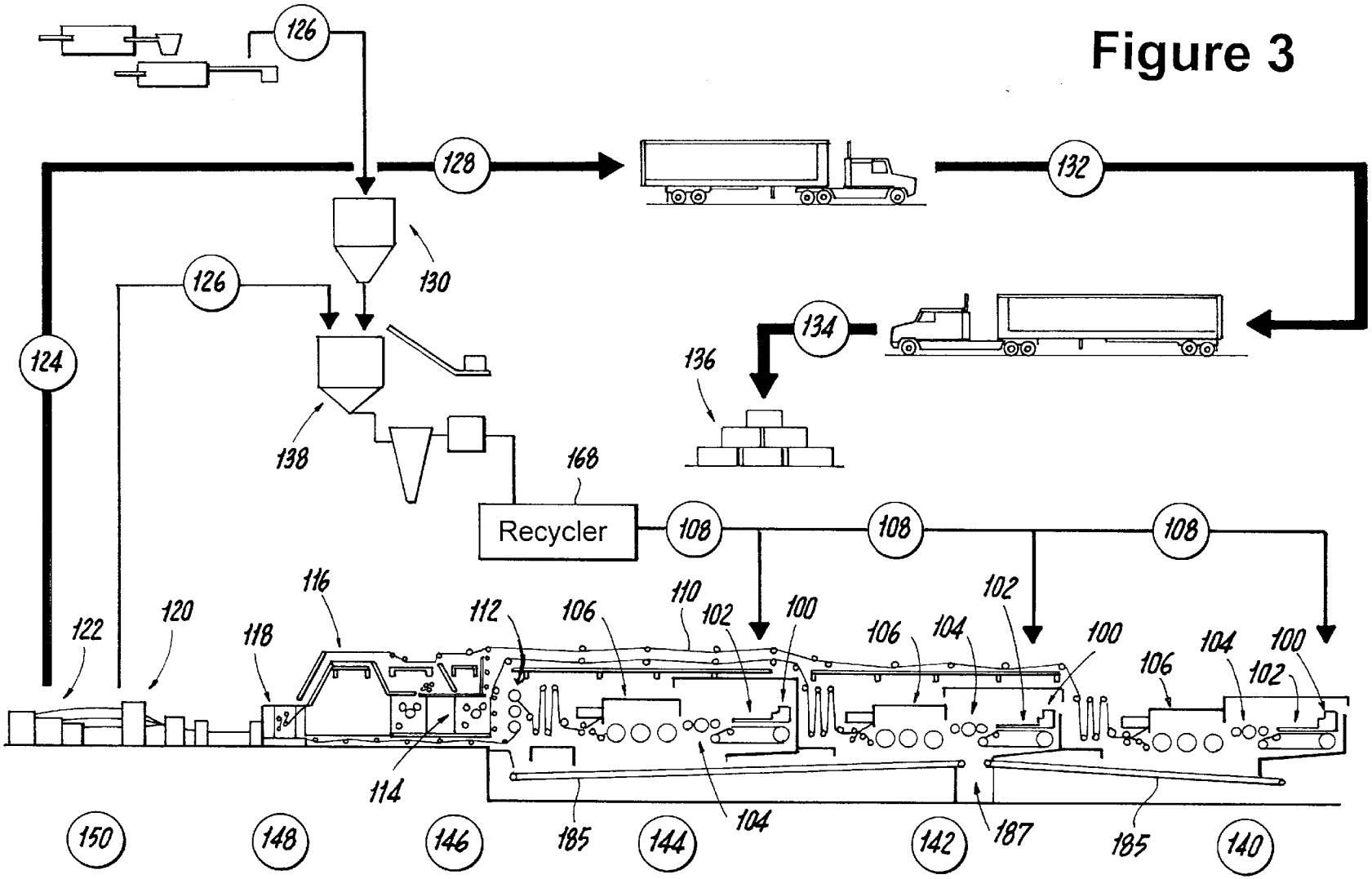
FIG. 3 shows a facility for producing corrugated products.

FIG. 3 illustrates an embodiment wherein pulp 108, which is delivered from storage chest 168 is distributed to headboxes 100 located in the inside linerboard, corrugating medium and outside linerboard making segments (140, 142 and 144 respectively). Pulp 108 is converted to board webs on board making segments 140, 142 and 144 by traveling on forming sections 102, traveling through press sections 104 and dryer sections 106. To add smoothness to the outside liner (the print side liner that forms the outside layer of a corrugated container), the linerboard web first travels through calendar section 112 which imparts a smoothness characteristic to the web. The inside linerboard web leaves board making segment 140 and travels over board making segments 142 and 144 by way of web guide device 110, which conventionally consists of web tensioning devices such as rollers. The corrugating medium web leaves board making segment 142 and travels over board making segment 144 by way of web guide device 110. The corrugating medium web and inside linerboard web enter the single facer segment 146 to be made into a single face corrugated web. The single face corrugated web travels on bridge 116 to the double backer 118 in double backer segment 148. There, it is joined with the outside linerboard web formed on board making segment 144, which traveled to segment 148 from segment 144 by way of web guide device 110. The single face web is bonded with adhesive to the outside linerboard web in the double backer segment 148.

The board exits the double backer segment 118 where it is typically slit and cut into corrugated sheets at a slitter/cutter 120. Sheets are then typically stacked and delivered on down stacker 122.

The stacked sheets 124 then can travel to on-site corrugated container converting equipment 128 that converts the sheets to corrugated containers or is bound for shipment to sheet plants for conversion to corrugated containers.

Broke (pulp fibers and dry paper breaks) that falls beneath the machines can travel on wet conveyors 185 to a common pulper 187 for repulping the fibers to re-enter the system. Similarly, the waste at the corrugator segments can be gathered to a common pulper to recover fibers for remanufacture into board.

Figure 4:
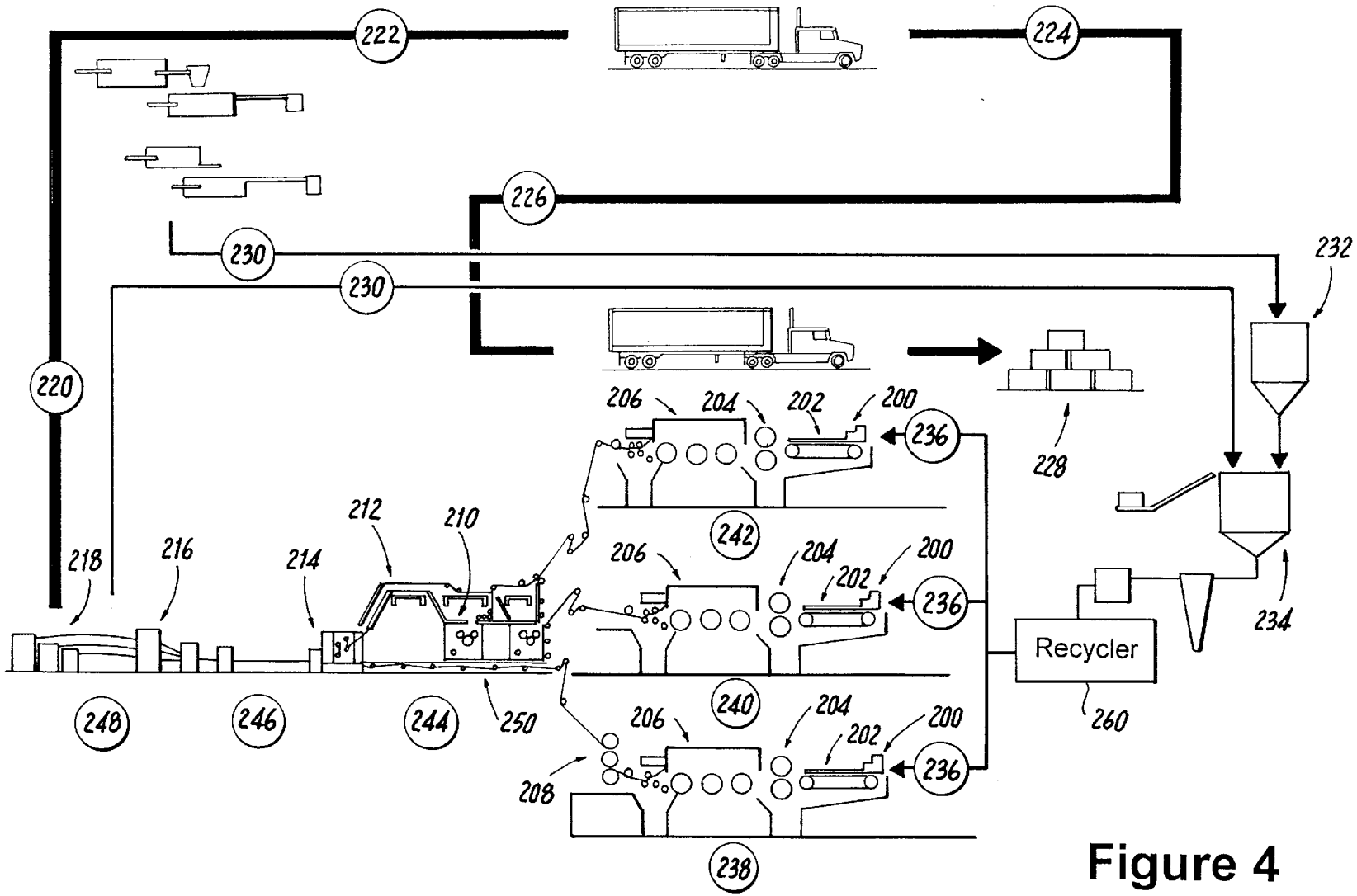
FIG. 4 shows a facility for producing corrugated products.

FIG. 4 illustrates an embodiment wherein pulp 236, which is delivered from storage chest 260 is distributed to headboxes 200 located in the inside linerboard, corrugating medium and outside linerboard making segment (242, 240 and 238 respectively). Pulp 236 is converted to board webs on board making segments 242, 240 and 238 by traveling on forming sections 202, traveling through press sections 204 and dryer sections 206. To add smoothness to the outside liner (the print side liner that forms the outside layer of a corrugated container), the linerboard web first travels through calendar section 208 which imparts a smoothness characteristic to the web. As shown in FIG. 4, the board making segments are oriented in a stacked fashion. The corrugating medium and inside linerboard webs from segments 240 and 242 enter the single facer segment 244 to be joined into a single face corrugated web, which travels over bridge 212 and enters the double backer segment 246. The outside linerboard web leaves board making segment 238 and is guided by web guiding system 250 to enter double backer segment 246. The single face web is bonded with adhesive to the outside linerboard web in the double backer segment 246.

The board exits the double backer segment 246 where it is typically slit and cut into corrugated sheets at a slitter/cutter 216. Sheets are then typically stacked and delivered on down stacker 218.

The stacked sheets then can travel to on-site corrugated container converting equipment 222 that converts the sheets to corrugated containers or is bound for shipment to sheet plants for conversions to corrugated containers.

The above illustrations show three possible configurations of the invention of producing a web or webs of containerboard that are subsequently used to produce corrugated board without the intermediate process of winding the containerboard on a web, cutting off the web to form a roll of containerboard and subsequently unwinding the roll of containerboard to combine webs into a corrugated sheet. Countless other configurations exist for layouts of the various board manufacturing and corrugation segments.

What is claimed is:

1. A single machine for producing corrugated board comprising;

an inside liner board segment;

an outside linerboard segment;

a corrugating medium segment; each of said segments comprising a headbox, paper forming section, pressing section and a dryer section.

2. The system of claim 1 wherein said inside linerboard segment, outside linerboard segment and corrugating medium segment are in a line.

3. The system of claim 1 wherein said inside linerboard segment, outside linerboard segment and corrugating medium segment each comprise an air laid former.

4. The system of claim 1 wherein print side linerboard forming segment further comprises a calendar section.

5. The system of claim 1 wherein said corrugating medium segment and said inside linerboard segment are placed back to back.

6. The system of claim 1 wherein two of said segments are placed back to back and said third segment is located above or below one of said two back to back segments.

7. The system of claim 1 wherein said segments are oriented in a stacked fashion.

8. A process for producing corrugated board comprising;

delivering pulp to an inside linerboard segment, corrugating medium segment and an outside linerboard segment; each of said segments comprising a headbox, paper forming section, pressing section, pressing section and a dryer section;

converting pulp into three separate containerboard webs;

fluting said corrugating medium web;

bonding said inside linerboard web to said corrugating medium web forming a single face corrugated web;

joining said single corrugated web to said outside linerboard web forming a single wall corrugated board.

9. The method of claim 8 further comprising;

adding smoothness to said outside linerboard web prior to joining with said single face web.

10. The method of claim 8 further comprising;

slitting and cutting said single wall corrugated board into corrugated sheets.

11. The method of claim 8 wherein broke from said paperboard corrugation is moved to a pulper for repulping to create fibers to re-enter said method.

* * * * *